United States Patent [19]

Cho

[11] Patent Number: 4,595,119

[45] Date of Patent: Jun. 17, 1986

[54] WATER PROOF PAPER CANISTER

[76] Inventor: Choong M. Cho, #803, 23 Dong, Hanyang Apartment San 2 - 21, Apkujungdong, Kangnam-Ku, Seoul, Rep. of Korea

[21] Appl. No.: 744,416

[22] Filed: Jun. 13, 1985

[30] Foreign Application Priority Data

Jun. 22, 1984 [KR] Rep. of Korea ..... 84-5894
Mar. 28, 1985 [KR] Rep. of Korea ..... 85-3288

[51] Int. Cl.[4] ..... B65D 90/04
[52] U.S. Cl. ..... 220/450; 220/453; 220/461; 229/4.5
[58] Field of Search ..... 220/450, 418, 483, 454, 220/457, 461, 466; 229/4.5

[56] References Cited

U.S. PATENT DOCUMENTS

| | | | |
|---|---|---|---|
| 3,773,604 | 11/1973 | Desai et al. | 220/461 |
| 3,972,467 | 8/1976 | Whillock et al. | 220/450 |
| 4,182,462 | 1/1980 | Buff, Jr. | 220/450 |
| 4,280,653 | 7/1981 | Elias | 229/43 |
| 4,323,620 | 4/1982 | Iwabuchi et al. | 220/450 |
| 4,471,900 | 9/1984 | Kadunce | 220/450 |

*Primary Examiner*—Joseph Man-Fu Moy
*Attorney, Agent, or Firm*—Fleit, Jacobson, Cohn & Price

[57] ABSTRACT

Present invention relates to water proof paper canister, by giving the water proof characteristics to the surface of the circumference, top and bottom of tubular canister made of many fold thick paper, and forming the contents such as ammunition etc. stored in canister can be protected against permeation of moisture, formed to be able to relieve any shock from the top and bottom of canister.

2 Claims, 6 Drawing Figures

WATER PROOF PAPER CANISTER

FIELD OF THE INVENTION

Usually the containers storing a contents(e.g. explosive material) are, as well known, ofen have to be stored and piled for a long time in warehouse according to its large quantity in many cases, and inevitable to move the containers.

Therefore, when in the case storing the contents filled in usual tubular container which is simply rolled with the thick paper in many fold, it brings often the contents in container to have the change or damage for not being water proof by container itself entirely, e.g. in case explosive material filled in the container, it brings inefficient effect in detonating by moisture, and causing by the steel caps coupled to top and bottom of lid and container body respectively is becoming to be squashed by some shocks, there has been disadvantage occuring an accident against safety by the shock is transmitted to the contents in the container.

SUMMARY OF THE INVENTION

Present invention relates to water proof paper canister comprising tubular cask made of thick paper in many fold, asphalt coated thick paper on it, aluminium foil, asphalt coated thick paper again, polyester film laminated with heat sealable synthetic plastics on both side of it, are successively adhered with heat and press. Of course, steel and plastic caps coupled to canister are included also.

OBJECT OF THE INVENTION

An object of the present invention is that all over the surface of container is to be protected from moisture, and by sealing harmeticaly and completely the coupling portion between containers and steel caps with plastic caps worn on, and that the contents are not to be changed or damaged against moisture permeation. Another object of the present invention is that the contents such as explosive material or ammunition is further more to be protected from the external shock than traditional container when in the case moving the container.

DETAILED DESCRIPTION OF THE INVENTION

Water proof tubular paper canister is formed to wear the lid on it after a content is filled in, and consist of a lit and a body of canister seperatly. And it is formed to insert the steel caps to the top and bottom of canister respectively in order to reinforcement of lid and body of canister.

First fundamental embodiment of the present invention is explained with drawings.

Figure 2:
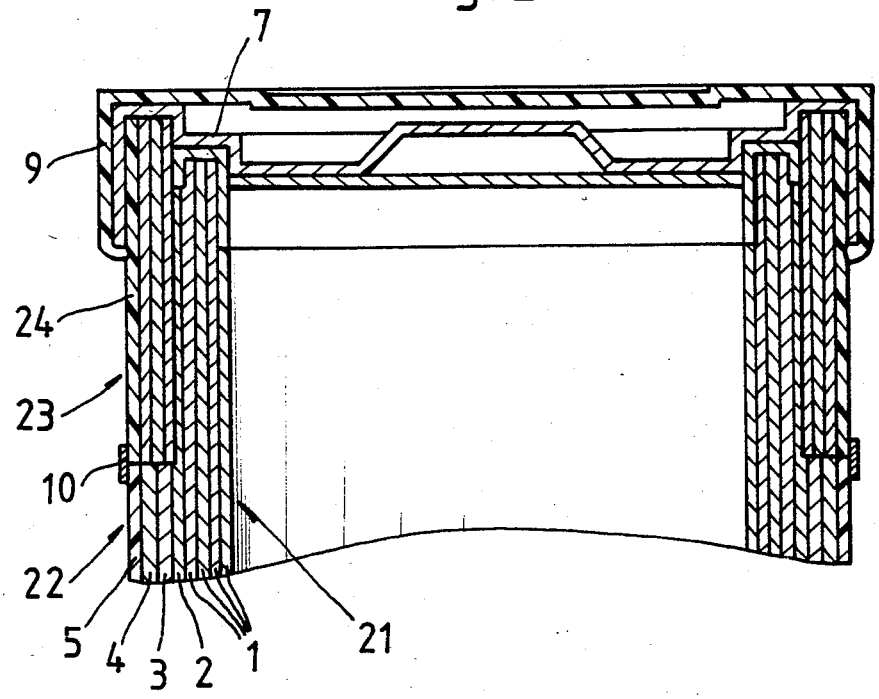
FIG. 2 is detailed cross sectional view of lid worn on to the upper part of paper canister according to the first embodiment of the present invention.
Figure 3:
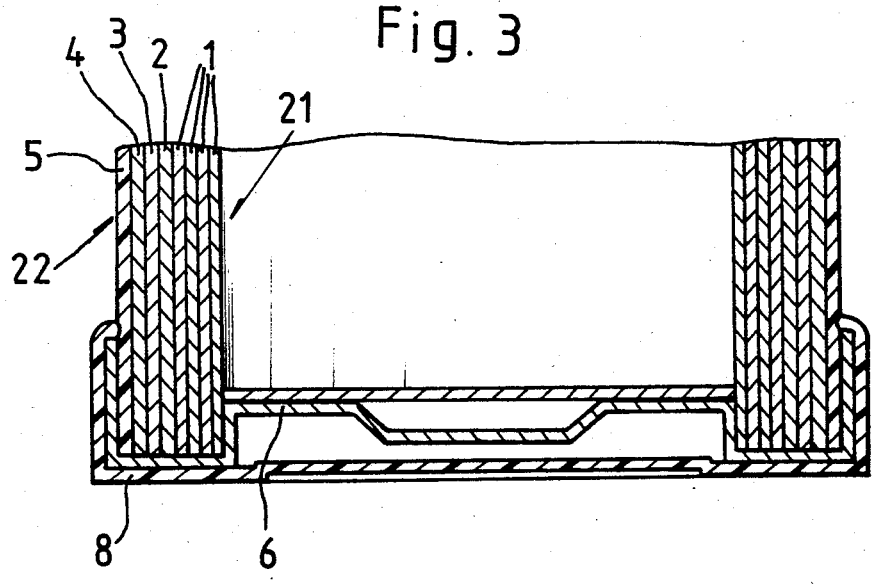
FIG. 3 is detailed cross sectionol view of the lower part of paper canister according to the first embodiment of the present invention.
Figure 4:
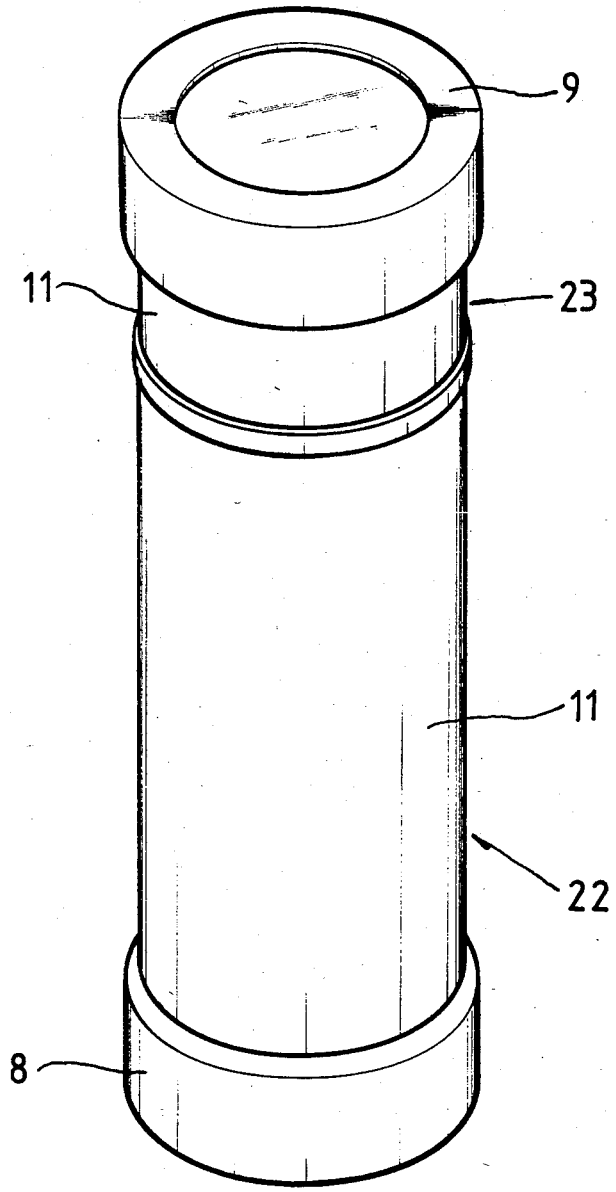
FIG. 4 shows perspective view of paper canister according to the second embodiment of the present invention.

FIGS. 2 and 3 show the detailed cross sectional view of lid and canister with caps of the present invention, as it is shown in FIGS. usually sylindical tubular cask(21) which is rolled up and adhered with the usual thick paper(1) in quadruple, another asphalt coated thick paper(2) is rolled up and adhered at the same time on around the surface of said sylindical tubular cask(21).

And aluminium foil(3) is rolled up and adhered also on it, then another more thick paper(4) coated with asphalt is rolled up and adhered again on around the surface of the aluminium foil(3).

And then, heat sealable synthetic plastics such a polyester film(5) which is laminated with polyethylene etc. on both side surface of it, is rolled up and adhered with heat and press on around the surface of the said thick paper(4).

In accordance with these methods, canister(22) of this invention is formed basically.

A lid(23) may not be same as many fold as body (22) of canister. Because, if the lid(23) were worn on the body(22) of canister, the purpose of water proof can be obtained naturally since the connected portion of lid and body is becoming in many fold.

The surface of above-described lid (23) as well as the surface of the body(22) of canister, is heat-sealed with polyester film(24) on which heat sealable synthetic plastics is laminated on the both side of it.

Of course, the lid(23) may be the one that polyester film(24) is heat-sealed on around the surface of the thick paper rolled up, or that polyester film(24) is heat-sealed on around the surface of which aluminium foil is inserted between each thick paper.

To the top of the lid(23) and to the bottom of the body(22) of the canister which is made like these way, the steel caps(6)(7) are inserted respectively for the purpose of reinforcement of the canister and lid, then put the plastic caps(8)(9) on it, and then the end of the plastic caps(8) is heat-sealed with press to the body(22) of canister as in FIG. 3, also the end of the plastic cap(9) is heat-sealed with press to the lid(23) in proper position.

To fill the contents in to this canister(22), opening the lid(23) and fill the some contents in, wear the lid on, then the contents will be stored in canister(22). However, the moisture may still be permeate through this contact portion because the contact between canister(22) and lid (23) may not be closed tightly. To prevent this problem, after worn the lid on the canister, sealing band(10) made of polyester film coated with plastics is applied to the connected circumference line, and heat-sealed with press so that is can be prevented against the moisture permeation.

Figure 1:
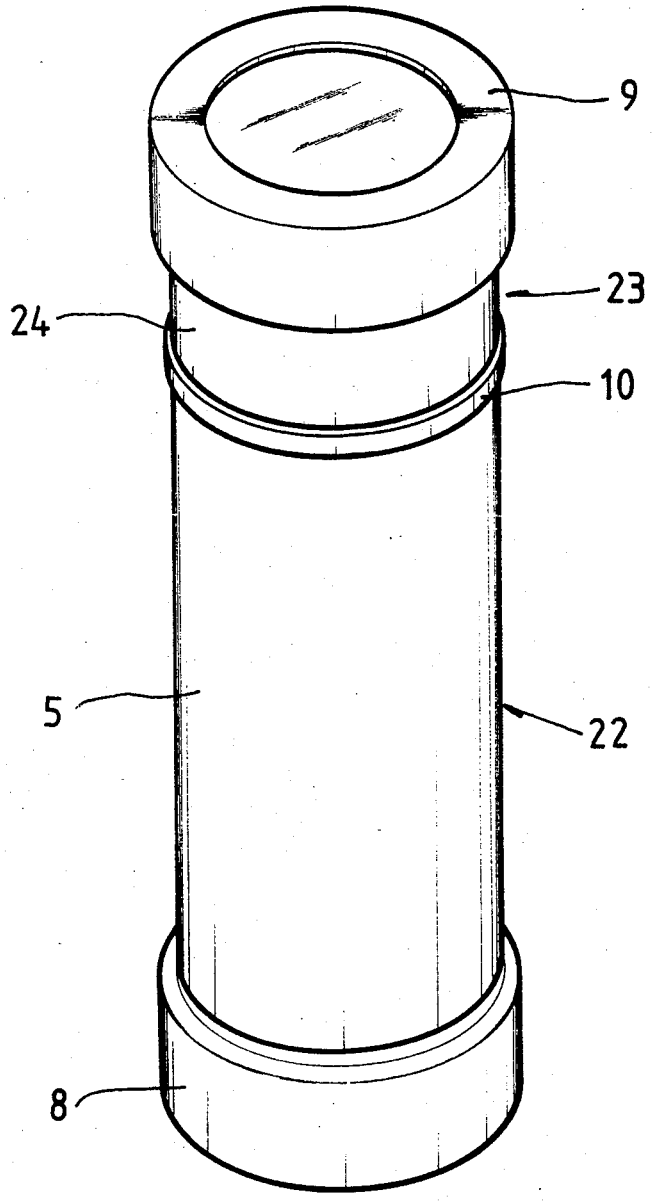
FIG. 1 shows the perspective view of paper canister according to the first embodiment of the present invention.

FIG. 1 denotes perspective view of completed out look of this invention.

According to the present invention as described in above, the effects are as followings, to the surface of sylindical tube cask(21), for the purpose of water proof, aluminium foil inserted between asphalt coated thick papers(2) and (4), by adhering with heat and press the polyester film(5) laminated with heat-sealable synthetic plastics on both side, not only adhesion is increased but also the effect of water proof against moisture and water too, and the contents of canister will not be affected by outside temperature, and the contents such as an explosive material is stored with keeping the original condition without any damage during the storage for a long time.

Particularly, the end of plastic cap(8) is sealed with heat and press to the body(22) of canister, and also said cap(9) is sealed to the lid (23), by sealing completely the microscopic gap of these parts, as a matter of course, complete water proof is obtained with regard to connected weak portion, and if some shock were given to the body of canister or top and/or bottom, it can be absorbed and relieved by plastic caps so that the contents in the canister is protected from any shock. Besides tensile strength is increased by the reason that canister is consisted in many fold.

Therefore, the present invention can be protected safely from accident causing by mishandling and without care.

In the first fundemental embodiment of this invention, to draw the contents out of canister, it is achieved by cutting along the sealing band(10) with cutting knife(omitted in drawings) and open the lid and then can draw it out.

And next, the second embodiment of the present invention is explained as followings;

In this case, same number will be applied to similar parts as in first case of this invention, and description of those parts will be simplified.

Figure 5:
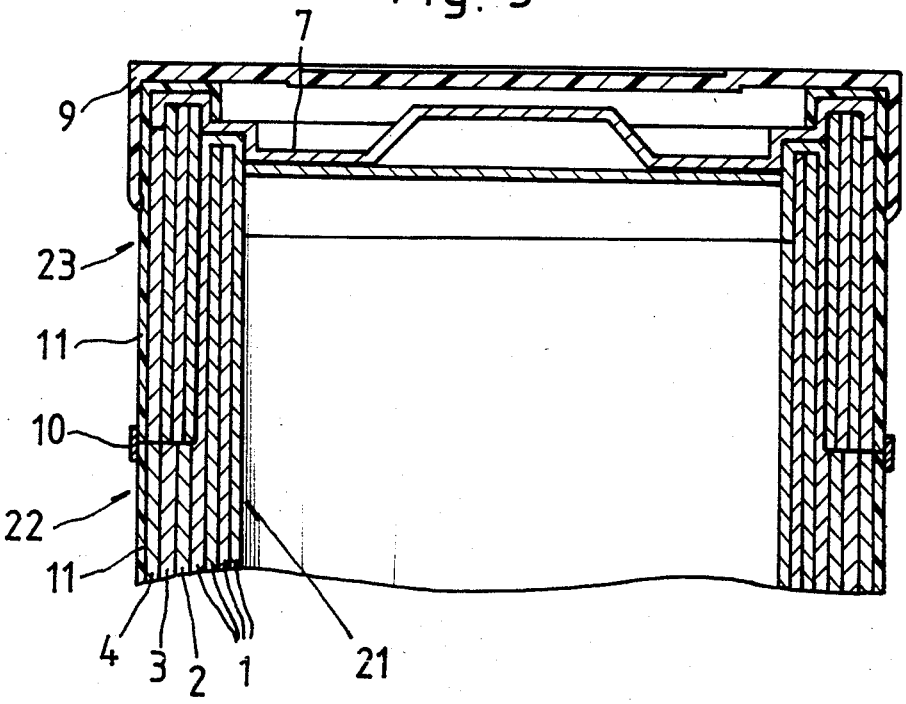
FIG. 5 is detailed cross sectional view of lid wearing on the upper part of paper canister according to the second embodiment of the present invention.
Figure 6:
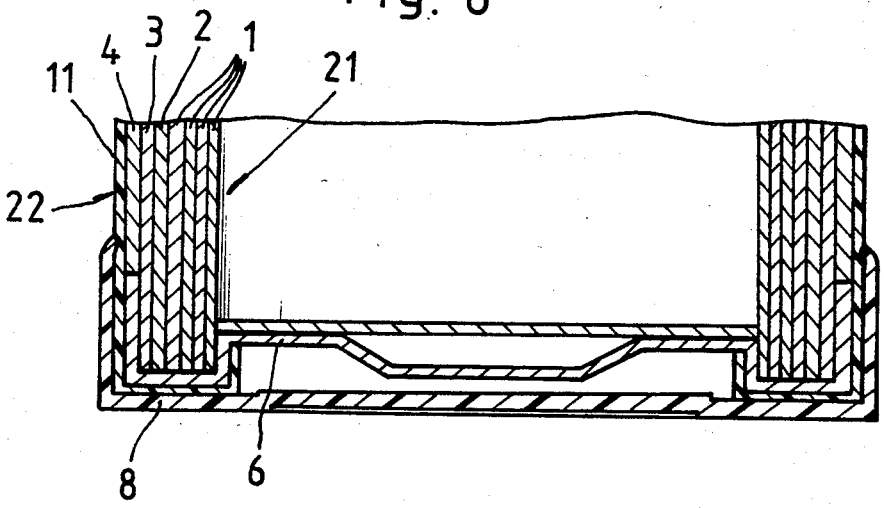
FIG. 6 is detailed cross sectional view of the lower part of paper canister according to the second embodiment of the present invention.

As in FIGS. 5 and 6, to the surface of the cask(21), asphalt coated thick paper(2), aluminium foil(3), again asphalt coated thick paper(4) is rolled up and adhered successively and steel cap(6) is inserted to the bottom of cask(21) and also steel cap(7) to the top of lid.

Above procedure is same as in first case, but from now different steps are taken.

After lid worn on canister(Z2), heat sealable synthetic film tube(11) is heat-press-sealed on around the entire length of canister and lid, and then it is seperated into two parts eaeh of canister (22) and lid(23) with kinfe cutting which is not denoted in drawing. Then. the canister(22) became in the condition of contents can be filled in it, but needs not to be filled still, and wear the lid on as it was.

From now same steps are taken again as in first case, after the plastic caps(8)(9) are worn on to the bottom of canister(22) and to the top of lid(23) respectively and then heat sealed to the surface of canister and lid respectivly. And now, the contents are filled in canister(22) and as in first case the sealing band(10) is heat sealed to the contact circumference line of canister(22) and lid(23).

According to this second embodiment of the present invention, further water proof effect is expected by sealing the microscopic gaps between canister(22) and steel cap(6)and also between lid(23) and steel cap(7) covering with heat sealable synthetic plastic film tube(11).

As descibed in above, present invention forms canister and lid on around the surface of sylindical tube cask for the purpose of water proof, and by sealing completly and hermeticaly against weak portion of conneting parts, can protect the contents filled in canister safely from moisture and change of out side atmosphere, and the contents can be stored and preserved as original condition without any damage inspite of long periodic storage by relieving the shock from out side with plastic caps.

I claim:

1. In sylindical tubular cask which thick paper is rolled up and adhered in many fold, water proof paper canister comprising asphalt coated thick paper which is rolled up and adhered on around the surface of said sylindical tubular cask, aluminium foil and asphalt coated thick paper are rolled up and adhered on around the surface of it again, polyester film laminated with heat sealable synthetic plastic on both side of it is rolled up and adhered with heat and press on around the surface of the asphalt coated thick paper, steel caps are inserted to the bottom of canister and to the top of lid respectively, wearing the synthetic plastic caps on these steel caps, and the end of the plastic caps are sealed with heat and press to the circumference of the body of canister and lid respectively.

2. Water proof paper canister according to claim 1, wherein a body of canister with steel cap and a lid with steel cap respectively are covered wholly and sealed with heat and press with heat sealable synthetic plastic tubular film.

* * * * *